United States Patent [19]

Fuss

[11] Patent Number: 4,939,004

[45] Date of Patent: Jul. 3, 1990

[54] CHRISTMAS TREE ORNAMENT

[76] Inventor: Lloyd J. Fuss, 132 Fox Chase Dr., Delran, N.J. 08075

[21] Appl. No.: 426,674

[22] Filed: Oct. 26, 1989

[51] Int. Cl.[5] ..... A47G 33/06; A47G 33/10

[52] U.S. Cl. ..... 428/9; D11/118; D11/128; 362/123; 362/124; 428/16; 428/19; 428/20; 428/28; 446/390; 446/485

[58] Field of Search ..... 428/16, 18, 19, 20, 428/28, 7–11, 9; 362/123, 124; 446/390, 391, 485; D11/117, 118, 124, 125, 128, 129

[56] References Cited

U.S. PATENT DOCUMENTS

| | | | |
|---|---|---|---|
| D. 144,086 | 3/1946 | Wandt | D11/129 X |
| 1,975,765 | 10/1934 | Brennan | 428/31 X |
| 2,113,038 | 4/1938 | Thalinger | 428/7 |
| 2,313,378 | 3/1943 | Wolf | D11/124 X |
| 2,749,432 | 6/1956 | Dorsey | 428/7 X |
| 2,851,807 | 9/1958 | Taylor | 428/19 |
| 3,085,545 | 4/1963 | Ore | 428/16 X |
| 3,603,780 | 9/1971 | Lu | 428/20 X |
| 3,940,521 | 2/1976 | Hack | 428/7 |
| 3,967,019 | 6/1976 | Magee | 428/18 X |
| 4,145,731 | 3/1979 | Adamich | 428/9 X |
| 4,428,988 | 1/1984 | Adinamis | 428/20 X |
| 4,756,936 | 7/1988 | Frank et al. | 428/19 X |
| 4,777,571 | 10/1988 | Morgan | 362/123 |

*Primary Examiner*—Henry F. Epstein
*Attorney, Agent, or Firm*—Jerry T. Kearns

[57] ABSTRACT

Christmas tree ornaments for attachment to a conventional natural or artificial Christmas tree include representations of a pair of human hands and a human head. Each of the ornaments are formed from a translucent plastic material and have an internal electric light. An elongated telescopically adjustable strut is secured to each of the ornaments and has a plurality of spaced spring biased clamps. The clamps are utilized to secure the ornaments to a tree. Power cords from the electric lights within each ornament extend through the associated strut. The ornaments include representations of a human head and hands to enable decoration of a tree to simulate various famous individuals and fictional characters.

2 Claims, 4 Drawing Sheets

CHRISTMAS TREE ORNAMENT

BACKGROUND OF THE INVENTION

1. Field of the Invention

The present invention relates to Christmas tree ornaments, and more particularly pertains to a novel form of Christmas tree ornaments which enables a conventional natural or artificial Christmas tree to be decorated so as to resemble a human individual.

2. Description of the Prior Art

Various types of Christmas tree ornaments are known in the prior art. A typical example of such a Christmas tree ornament is to be found in U.S. Pat. No. 2,851,807, which issued to O. Taylor on Sept. 16, 1958. This patent discloses an artificial Christmas tree including a plurality of spaced spherical ornaments. U.S. Pat. No. 3,085,545, which issued to E. Ore on Apr. 16, 1963, discloses a tree ornament in the form of a cat face adapted for securement by a string from a natural tree to scare away birds and small animals from orchards. U.S. Pat. No. 3,967,019, which issued to A. Magee on June 29, 1976, discloses an ornamental artificial tree including a plurality of electric lights secured to a generally conical open wire frame. U.S. Pat. No. 4,145,731, which issued to A. Adamich on Mar. 20, 1979, discloses a simulated collapsible Christmas tree including a collapsible spiral ornament structure. U.S. Pat. No. 4,428,988, which issued to P. Adinamis on Jan. 31, 1984, discloses a collapsible simulated Christmas tree formed from light transmitting components which may be packaged as a kit and subsequently erected to provide a simulated illuminated Christmas tree. U.S. Pat. No. 4,777,571, which issued to C. Morgan on Oct. 11, 1988, discloses a Christmas tree fiber optical lighting system.

While the above mentioned devices are directed to Christmas tree ornaments, none of these devices disclose tree ornaments which enables a natural or synthetic tree to be decorated to simulate a human individual. Additionally, none of the aforesaid devices disclose the use of telescopic adjustable struts having spaced spring clamps for securing an ornament to a tree. Inasmuch as the art is relatively crowded with respect to these various types of Christmas tree ornaments, it can be appreciated that there is a continuing need for and interest in improvements to such Christmas tree ornaments, and in this respect, the present invention addresses this need and interest.

SUMMARY OF THE INVENTION

In view of the foregoing disadvantages inherent in the known types of Christmas tree ornaments now present in the prior art, the present invention provides an improved Christmas tree ornament. As such, the general purpose of the present invention, which will be described subsequently in greater detail, is to provide a new and improved Christmas tree ornament which has all the advantages of the prior art Christmas tree ornaments and none of the disadvantages.

To attain this, representative embodiments of the concepts of the present invention are illustrated in the drawings and make use of Christmas tree ornaments for attachment to a conventional natural or artificial Christmas tree which include representations of a pair of human hands and a human head. Each of the ornaments are formed from a translucent plastic material and have an internal electric light. An elongated telescopically adjustable strut is secured to each of the ornaments and has a plurality of spaced spring biased clamps. The clamps are utilized to secure the ornaments to a tree. Power cords from the electric lights within each ornament extend through the associated strut. The ornaments include representations of a human head and hands to enable decoration of a tree to simulate various famous individuals and fictional characters.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas tree ornament which has all the advantages of the prior art Christmas tree ornaments and none of the disadvantages.

It is another object of the present invention to provide a new and improved Christmas tree ornament which may be easily and efficiently manufactured and marketed.

It is a further object of the present invention to provide a new and improved Christmas tree ornament which is of a durable and reliable construction.

An even further object of the present invention is to provide a new and improved Christmas tree ornament which is susceptible of a low cost of manufacture with regard to both materials and labor, and which accordingly is then susceptible of low prices of sale to the consuming public, thereby making such Christmas tree ornaments economically available to the buying public.

Still yet another object of the present invention is to provide a new and improved Christmas tree ornament which provides in the apparatuses and methods of the prior art some of the advantages thereof, while simultaneously overcoming some of the disadvantages normally associated therewith.

Still another object of the present invention is to provide a new and improved Christmas tree ornament which enables a natural or artificial tree to be decorated to resemble a human individual.

Yet another object of the present invention is to provide a new and improved Christmas tree ornament which utilizes a telescoping adjustable securement strut.

Even still another object of the present invention is to provide a new and improved Christmas tree ornament which utilizes a plurality of spring clamps in conjunction with a telescoping strut for securing an illuminated ornament to a tree.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
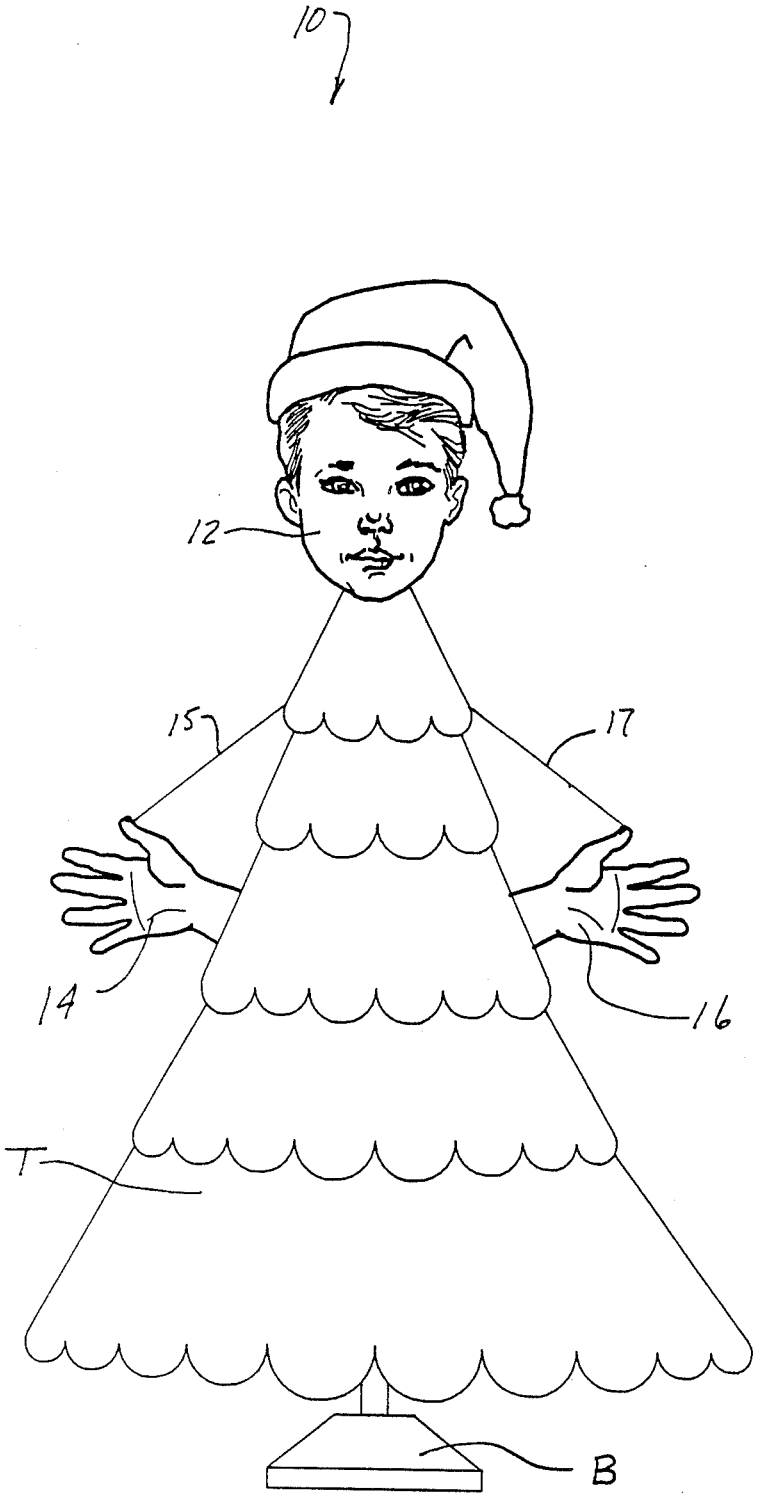
FIG. 1 is a front view of a Christmas tree decorated with the ornaments according to the present invention.

With reference now to the drawings, and in particular to FIG. 1 thereof, a new and improved Christmas tree ornament embodying the principles and concepts of the present invention and generally designated by the reference numeral 10 will be described.

More specifically, it will be noted that the first embodiment 10 of the invention includes a human head representation ornament 12 secured adjacent an apex of a conventional tree T. Human hand representational ornaments 14 and 16 are secured adjacent intermediate portions at opposite sides of the tree T. Cords 15 and 17 assist in the securement of the ornaments 14 and 16. The tree T may be of a natural or artificial type, and preferably includes a conventional supporting base B.

Figure 2:
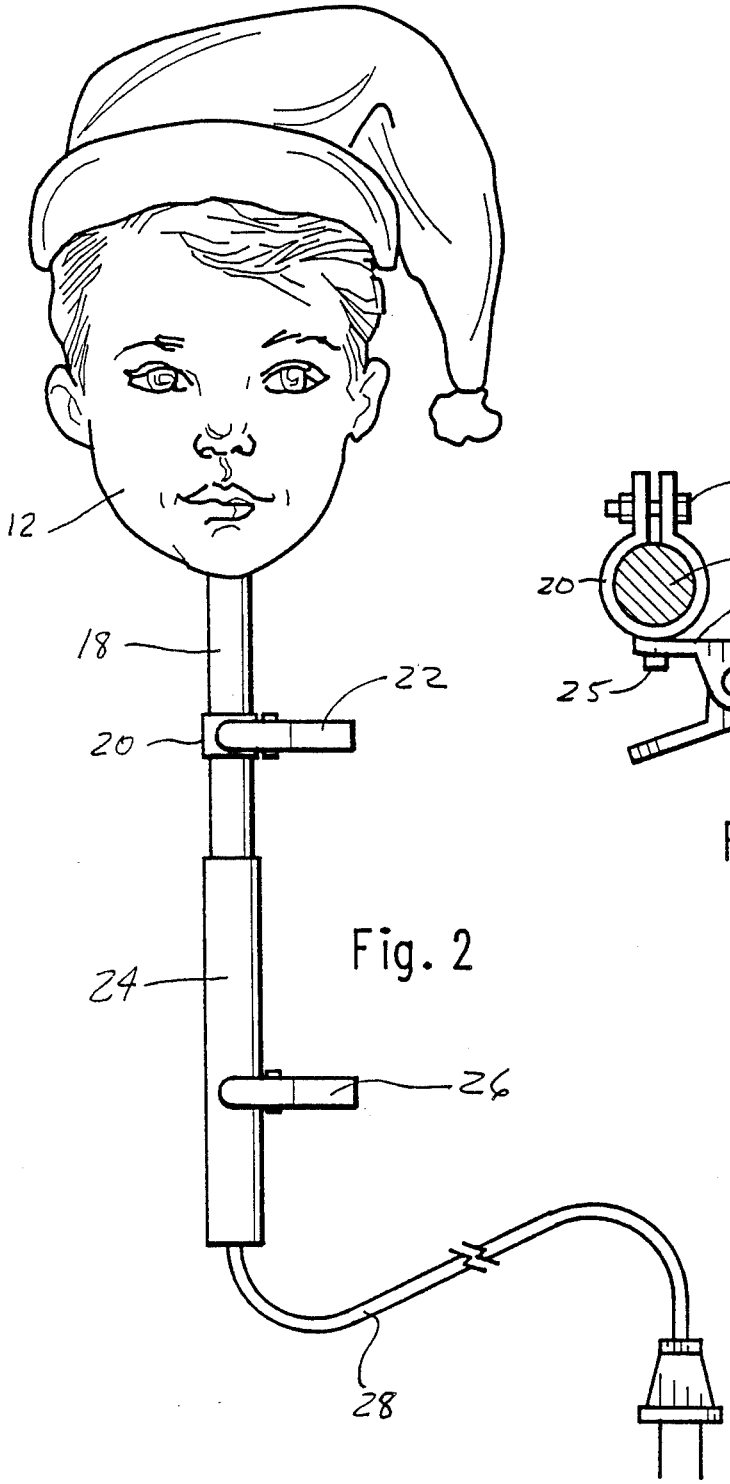
FIG. 2 is a front view illustrating a human head representation ornament.

FIG. 2 illustrates the human head representation ornament 12 which is secured to the distal end of an elongated tubular rod 18. An encircling clamping member 20 is secured to the rod 18 and includes a spring clamp 22 having a pair of arcuate, spring biased clamping jaws adapted for engagement with limbs or branches of a tree. The rod 18 is telescopically received within a tubular member 24. The rod 18 and tubular member 24 form a telescopically adjustable strut. An additional clamping member 26 is secured to the tubular member 24. An electric light is disposed within the interior of the ornament 12 and is operatively connected to a power cord 28. The ornament 12 is preferably formed from a translucent plastic material and may be formed to represent various famous characters and individuals. For example, the ornament 12 may be configured to resemble Santa Claus.

Figure 3:
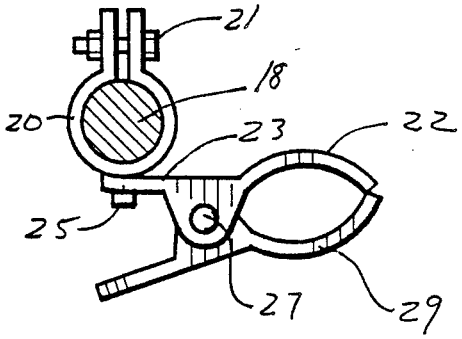
FIG. 3 is a detail view, partially in cross section, illustrating the spring clamp ornament securing member.

As shown in FIG. 3, the spring clamp 22 includes a pair of arcuate jaws 22 and 29 connected by a pivot pin 27. A torsional coil spring surrounds the pin 27 and biases the jaws to the illustrated closed position, for engagement with a tree limb or branch. The leg portion 23 of the clamp 22 is secured by a rivet or screw 25 to the encircling clamp portion 20 which surrounds the strut 18. A screw 21 extends through free leg portions of the encircling clamp 20, thus adjustably securing the clamp 22 at a selected position along the rod 18. This allows the ornament to be readily adapted for use with various different tree dimensions.

Figure 4:
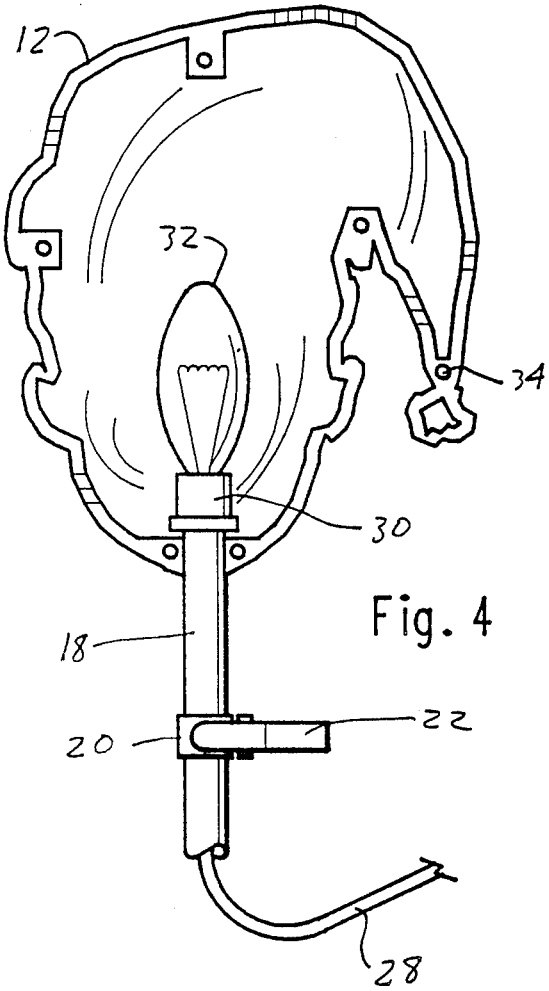
FIG. 4 illustrates the illumination system of the ornament of FIG. 2.

FIG. 4 illustrates the interior of the ornament 12, with one back half portion removed therefrom. A plurality of screw bosses 34 are provided for removably securing the back cover plate. A conventional electric light 32 is mounted within a socket 30 provided on a distal end of the rod 18, within the ornament 12.

Figure 5:
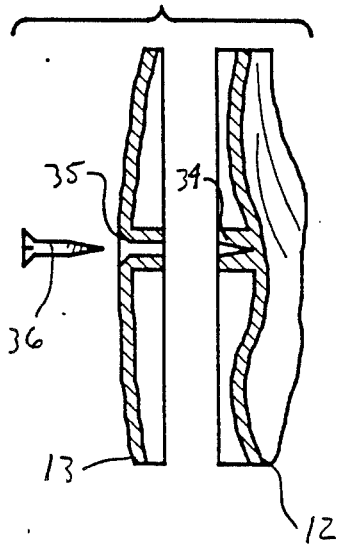
FIG. 5 is a detail view illustrating the construction of the ornament of FIG. 2.

As shown in FIG. 5, the back cover plate 13 includes a plurality of similar screw bosses 35, disposed in juxtaposition with the bosses 34 provided on the front plate 12. A plurality of conventional screws 36 are utilized to secure the back 13 and front plates 12.

Figure 6:
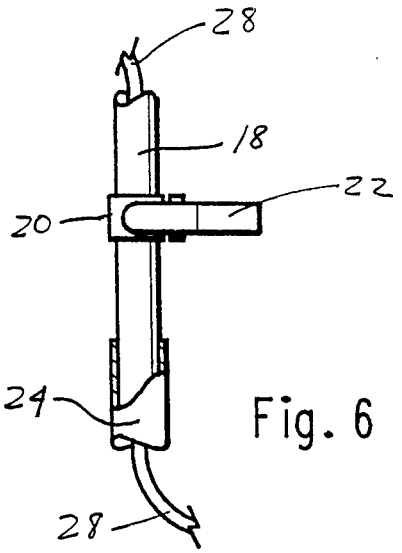
FIG. 6 is a detail view, partially cut away, illustrating the telescopic adjustable strut construction.

FIG. 6 illustrates the rod 18 slidably received within the hollow interior of the tubular member 24. This construction allows an adjustment in length of the ornament securing strut, and allows a hidden passage of the power cord 28.

Figure 7:
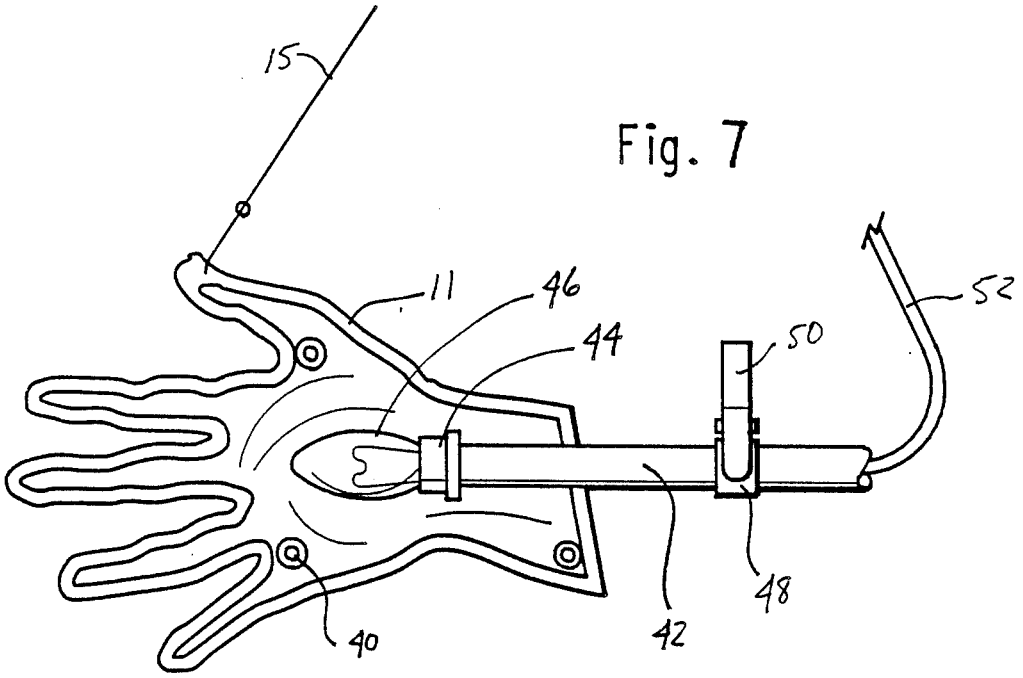
FIG. 7 illustrates the internal electric light assembly of the human head representation ornament.

FIG. 7 illustrates the back cover plate 11 of the human hand representational ornament. A suspension cord 15 may be secured to the hand ornament, to assist in stabilizing the ornament in a desired position. A plurality of bosses 40 are provided within the back plate 11 for engagement by conventional threaded fasteners. An electric light bulb 46 is retained within a socket 44 provided at a distal end of the rod 42, within the interior of the ornament plate 11. An encircling clamp portion 48 of an arcuate spring biased clamp 50 is adjustably secured to the rod 42. A power cord 52 extends through the hollow interior of the rod 42 into operative connection with the socket 44 for illuminating the light 46.

Figure 8:
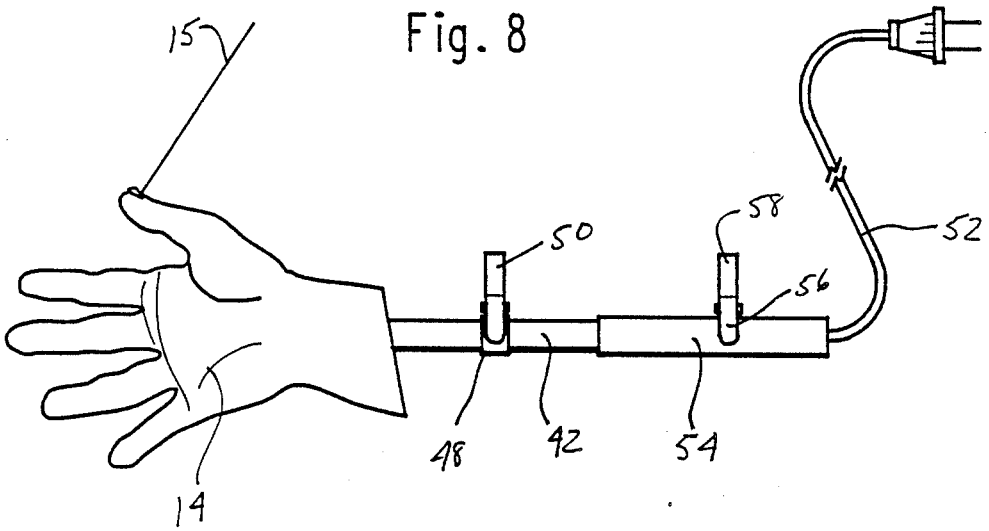
FIG. 8 is an assembled view of the human hand representation ornament.

As shown in FIG. 8, the front cover plate 14 of the human hand ornament encases the interior electric light. As previously described, the ornament 14 is preferably formed from a translucent plastic material to allow light to shine therethrough. The rod 42 is telescopically received within a tubular member 54. A spring biased clamp 58 is secured at 56 to the tubular member 54, and serves to secure the adjustable strut to a tree.

As may now be understood, the present invention provides a set of Christmas tree ornaments which are easily adaptable for use with various different sizes of trees, and which allow a tree to be decorated in a unique representation of a variety of famous characters and individuals.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. Christmas tree ornaments for decorating a tree in a manner simulating a human individual, comprising:

a first elongated adjustable strut having a plurality of relatively slidable telescoping sections;

a first ornament member secured adjacent one end portion of said strut;

said first ornament member including a first electrical light and a representation of a human head;

a second elongated adjustable strut having a plurality of relatively slidable telescoping sections;

a second ornament member secured adjacent one end portion of said second strut;

said second ornament member including a second electrical light and a representation of a human hand;

a third elongated adjustable strut having a plurality of relatively slidable telescoping sections;

a third ornament member secured adjacent one end portion of said third strut;

said third ornament member including a third electrical light and a representation of a human hand;

power cord means extending through each of said struts and connected to each of said electrical lights; and a plurality of arcuate clamps on each of said struts for securing said struts to a Christmas tree, each of said clamps having a pair of spring biased jaws.

2. The Christmas tree ornament of claim 1, wherein each of said ornament members are formed from a translucent plastic material.

* * * * *